US011134767B2

(12) United States Patent
Mizumura et al.

(10) Patent No.: US 11,134,767 B2
(45) Date of Patent: Oct. 5, 2021

(54) SHOULDER STRAPS FOR BACKPACK AND BACKPACK PROVIDED WITH SAME

(71) Applicant: RYOHIN KEIKAKU CO., LTD., Toshima-ku (JP)

(72) Inventors: Manami Mizumura, Kanagawa (JP); Yasumichi Ota, Tokyo (JP); Ryo Ishii, Kanagawa (JP)

(73) Assignee: RYOHIN KEIKAKU CO., LTD., Toshima-ku (JP)

( * ) Notice: Subject to any disclaimer, the term of this patent is extended or adjusted under 35 U.S.C. 154(b) by 0 days.

(21) Appl. No.: 16/346,179

(22) PCT Filed: Sep. 29, 2017

(86) PCT No.: PCT/JP2017/035376
§ 371 (c)(1),
(2) Date: Apr. 30, 2019

(87) PCT Pub. No.: WO2018/088056
PCT Pub. Date: May 17, 2018

(65) Prior Publication Data

US 2020/0060411 A1 Feb. 27, 2020

(30) Foreign Application Priority Data

Nov. 8, 2016 (WO) ..... PCT/JP2016/083142

(51) Int. Cl.
*A45F 3/12* (2006.01)
*A45F 3/04* (2006.01)

(52) U.S. Cl.
CPC . *A45F 3/12* (2013.01); *A45F 3/04* (2013.01)

(58) Field of Classification Search
CPC ..... A45F 3/12; A45F 3/04
USPC ..... 224/264
See application file for complete search history.

(56) References Cited

FOREIGN PATENT DOCUMENTS

| | | | |
|---|---|---|---|
| EP | 0 356 762 | A1 | 3/1990 |
| EP | 2 027 794 | A1 | 2/2009 |
| JP | 61-109325 | U | 7/1986 |
| JP | 6-52546 | U | 7/1994 |
| JP | 2003-534029 | A | 11/2003 |
| JP | 3107416 | U | 2/2005 |
| JP | 2006-167114 | A | 6/2006 |

(Continued)

OTHER PUBLICATIONS

International Search Report dated Dec. 26, 2017 in PCT/JP2017/035376 filed on Sep. 29, 2017.

(Continued)

*Primary Examiner* — Peter N Helvey
(74) *Attorney, Agent, or Firm* — Oblon, McClelland, Maier & Neustadt, L.L.P.

(57) ABSTRACT

Provided are shoulder straps for a backpack in which the entire width of the shoulder strap is brought into contact with the shoulder from the upper joint portion with the backpack main body to the front part of the shoulder, thereby capable of dispersing a load concentrated on a local part of the shoulder, and a backpack including the shoulder straps for a backpack. A pair of left and right shoulder straps for a backpack, each of the shoulder straps for a backpack includes a core material having elasticity and a surface fabric covering the core material, wherein the core material has a difference in elevation so that a thickness of an outside of each shoulder strap is thicker than a thickness of an inside of each shoulder strap at least at a portion contacting a body.

15 Claims, 4 Drawing Sheets

(56) References Cited

FOREIGN PATENT DOCUMENTS

| | | |
|---|---|---|
| TW | M275744 U | 9/2005 |
| WO | WO 01/50909 A1 | 7/2001 |

OTHER PUBLICATIONS

Taiwanese Search Report in Patent Application No. 106138549 filed on Nov. 8, 2017.
Extended European Search Report dated Sep. 28, 2020 in European Patent Application No. 17870472.2, 8 pages.

[FIG.1]
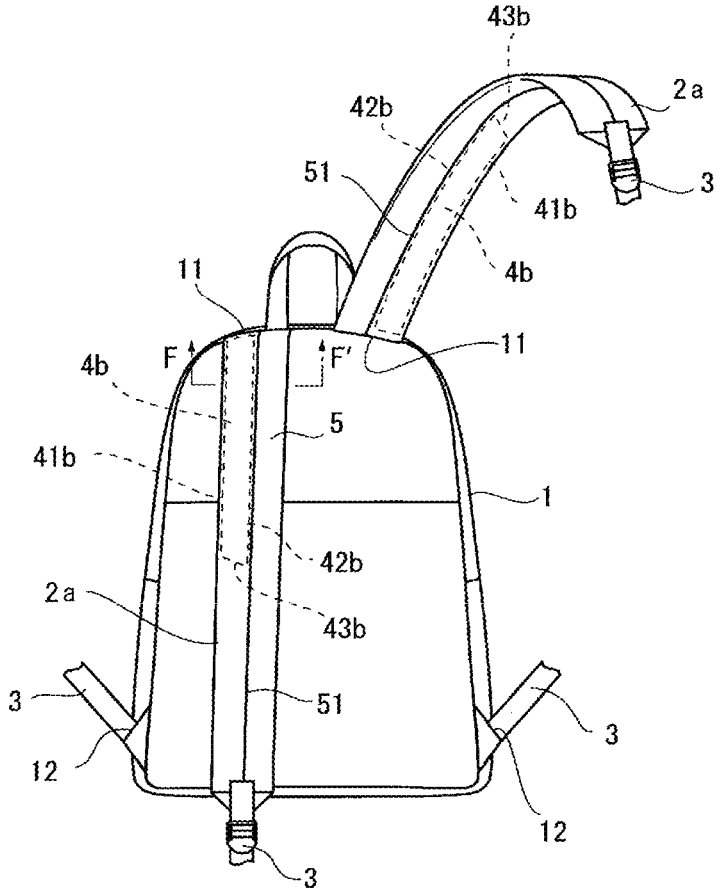
[FIG.2]
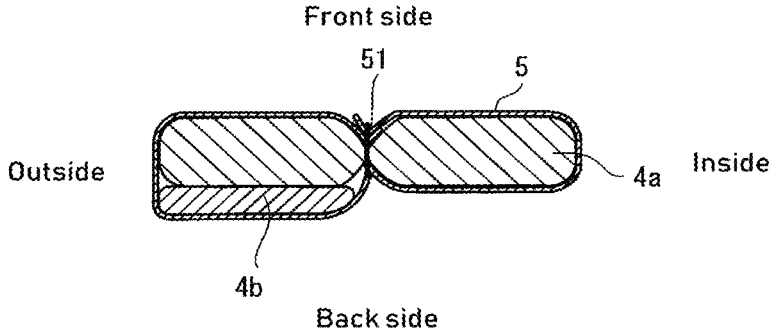

[FIG.3]
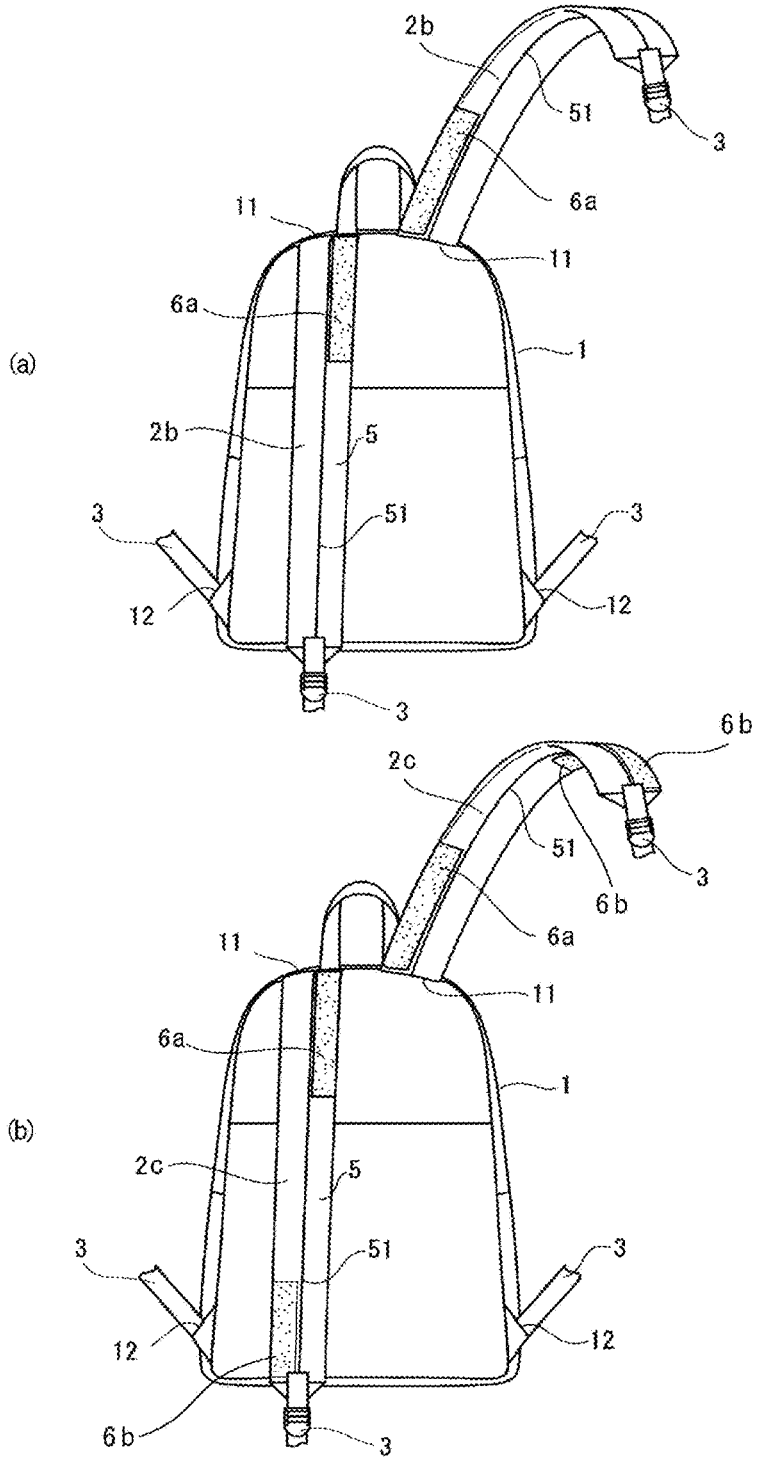

[FIG.4]
(a)
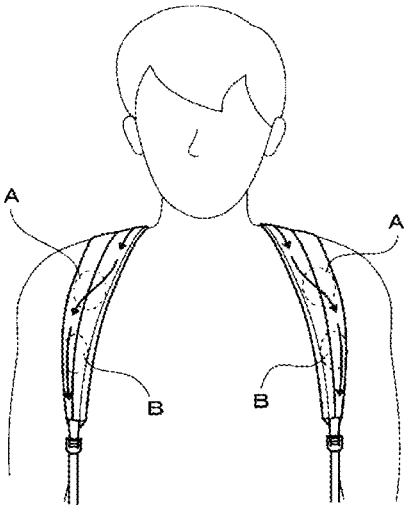
(b)
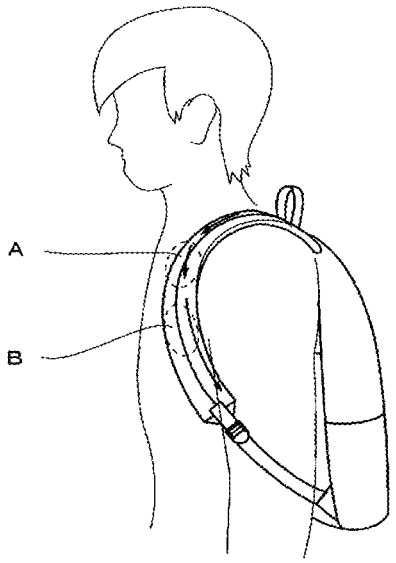
[FIG.5]
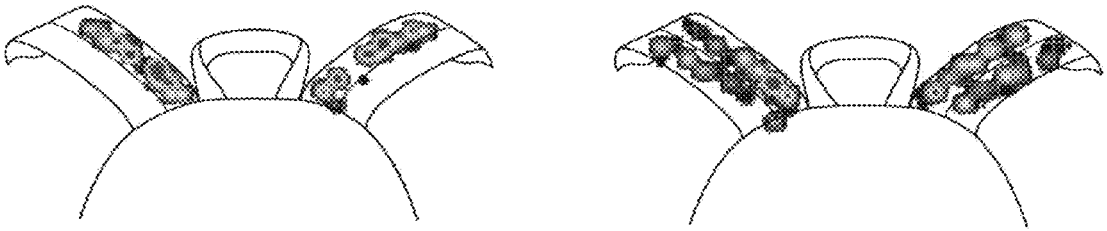
(a) (b)

[FIG.6]
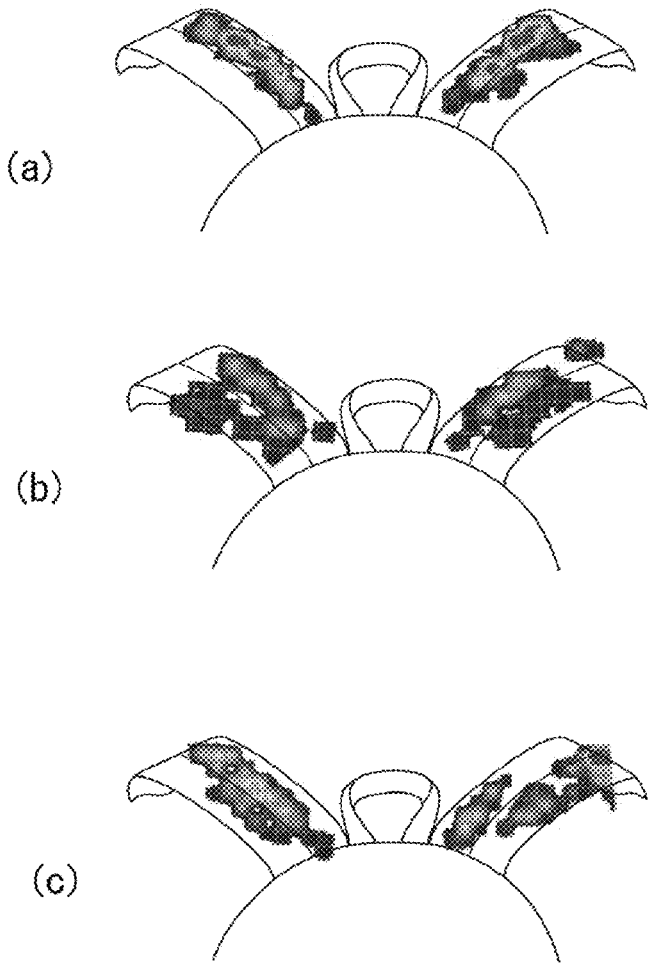

SHOULDER STRAPS FOR BACKPACK AND BACKPACK PROVIDED WITH SAME

TECHNICAL FIELD

The present invention relates to shoulder straps for a backpack used for daily life or mountaineering, hiking and the like, and more specifically, to shoulder straps for a backpack having a function of dispersing a pressure due to a load concentrated on a contact part with a body and a backpack including the same.

BACKGROUND ART

Conventionally, a backpack provided with a pair of left and right shoulder straps has a structure in which an upper joint portion of a backpack main body and each shoulder strap is provided near the center of the upper part on the rear side of the backpack main body while a lower joint portion with the backpack main body is often provided on the left and right side surfaces or the lower parts close to the left and right side surfaces of the backpack main body. Due to the relative positional relationship between the upper joint portion and the lower joint portion as described above, when carrying the backpack on the back, the left and right shoulder straps are pulled outward with the space therebetween widened as going from the upper side to the lower side.

Furthermore, although the shoulder strap is directed to almost the front along the shape of the shoulder of the user from the top of the shoulder to the front of the shoulder, as it goes from the front part of the shoulder to the armpit part (region B in FIGS. 4(*a*) and 4(*b*)), twisting in the direction along the user's flank is applied, and changing the direction toward the lower joint portion is applied gradually.

Due to the structure of such a backpack, as shown by the arrows in FIGS. 4(*a*) and 4(*b*), the tension (pulling force in the downward direction) applied to the shoulder straps acts on the inside of the shoulder strap (in this specification, "inside of the shoulder strap" means the part close to the neck when worn) from the upper joint portion with the backpack main body to the front part of the shoulder, moves to the outside of the shoulder strap (in the present specification, "outside of the shoulder strap" means the part close to the arm when worn) in the vicinity of the region A of the front part of the shoulder, and acts mainly on the outside of the shoulder strap from the front part of the shoulder to the armpit.

As described above, since the causes of spreading and twisting of the shoulder straps act on the shoulder strap of the backpack in combination, a load of the backpack main body is strongly applied to the inside (neck side) of the shoulder strap in the vicinity of the upper joint portion with the backpack main body and a tension acts, whereas the load is not applied on the outside (arm side) of the shoulder strap and slack occurs, and a phenomenon of rising from the shoulder occurs.

Based on the above-mentioned backpack-specific structure, only the narrow region of the inside of the shoulder strap for a backpack is in contact with the shoulder, and the pressure due to the load was concentrated in this region. As a result, there is a problem that as the load increased, the weight exceeding the actual load is felt or the pain was felt at the shoulder with which the region is in contact.

On that point, Patent Literatures 1 and 2 disclose shoulder strap members for distributing a load from the shoulder strap on the shoulder, and reducing the burden on the shoulder.

However, these include a shock absorber (Patent Literature 1) newly functioning as an air cushion in addition to a conventional shoulder strap, and a shoulder pad (Patent Literature 2) for dispersing a load by using a pair of abutting portions formed by deforming a flat plate member into a substantially dogleg shape. None of these provides a method of dispersing the concentration of pressure due to the load applied to the inside of the shoulder strap attributed to the structure of the backpack in which the left and right shoulder straps are pulled in the direction where the distance between them expands from the upper side to the lower side when worn.

In addition, Patent Literature 3 discloses a shoulder strap of a shoulder bag including a shoulder belt or shoulder pad which is formed so as to be thicker toward the outside in accordance with the inclination of the shoulder whereby a load is averagely applied to the shoulder.

However, the disclosed shoulder belt and shoulder pad are intended for a shoulder bag. Generally, in a shoulder bag, tension acts in the same direction from the apex of the shoulder (the center of the shoulder) to the main body of the bag, and there is no twisting of the shoulder strap. In other words, a shoulder pad having a shape matching the inclination of the shoulder is merely added, and the structure does not have the shape which changes in the direction of dispersing the pressure due to the load biased toward the inside of the shoulder strap. Its object is to maintain the grounding state with the shoulder (prevention of sliding). In this way, the shoulder strap described in Patent Literature 3 does not provide a method of dispersing the concentration of pressure due to the load applied to the inside of the shoulder strap attributed to the structure of the backpack in which the left and right shoulder straps are pulled in the direction where the distance between them expands from the upper side to the lower side when worn.

Patent Literature 1: JP 2003-534029 A
Patent Literature 2: JP 3107416 U
Patent Literature 3: JP 2006-167114 A

SUMMARY OF INVENTION

Technical Problem

Accordingly, the present invention overcomes such disadvantages of conventional shoulder straps for a backpack. The entire width of the shoulder strap is brought into contact with the shoulder from the upper joint portion with the backpack main body to the front part of the shoulder. It is therefore an object of the present invention to provide shoulder straps for a backpack capable of dispersing a pressure due to a load concentrated on the local portion of the shoulder, and a backpack including the shoulder straps.

Solution to Problem

The present invention is to solve the above problem, and to provide a pair of left and right shoulder straps for a backpack, each of the shoulder straps for the backpack including a core material having elasticity and a surface fabric covering the core material, wherein the core material has a difference in elevation such that a thickness of an outside of each shoulder strap is thicker than a thickness of an inside of each shoulder strap at least at a portion contacting a body.

Further, the present invention provides the shoulder straps for a backpack, wherein the thicker part of the core material is disposed in a limited range from an upper joint portion or a vicinity of the upper joint portion to a front part of a shoulder.

The present invention provides a pair of left and right shoulder straps for a backpack, each of the shoulder straps for the backpack including a core material having elasticity and a surface fabric covering the core material, wherein the surface fabric includes two types of surface fabrics having different stretchabilities, and stretchability of a portion of the surface fabric at least in a vicinity of an upper joint portion of each shoulder strap and a backpack main body and on an inside of the shoulder strap is larger than stretchability of the other portion of the surface fabric.

Furthermore, the present invention is a backpack comprising the above shoulder straps for a backpack.

Advantageous Effects of Invention

The shoulder straps for a backpack according to the present invention, wherein the core material has a difference in elevation such that the thickness of the outside of each shoulder strap is thicker than the thickness of the inside of each shoulder strap at least at a portion contacting a body, comes into contact with the shoulder by the entire shoulder strap width, so that it is possible to appropriately disperse the pressure due to the load concentrated on the inside of the shoulder strap. More specifically, as the load weight increases, the thicker part of the outer core material is crushed until the loads applied to the inside and the outside of the shoulder strap are balanced. As a result, the outside of the shoulder strap has no slack, and the load is equally applied to the inside and the outside of the shoulder strap, so that the entire shoulder strap comes into contact with the shoulder equally.

Further, in the shoulder straps for a backpack according to the present invention, wherein the core material has a difference in elevation such that the thickness of the outside of each shoulder strap is thicker than the thickness of the inside of each shoulder strap, members for conventional shoulder straps for a backpack can be used as it is, and it is only necessary to partially change the thickness of the core material, so that it is possible to produce at low cost without making major changes to the production process of the ordinary backpack.

In addition, in the shoulder straps for a backpack according to the present invention, wherein the core material has a difference in elevation such that the thickness of the outside of each shoulder strap is thicker than the thickness of the inside of each shoulder strap, the core material is processed, so that there is no influence on the design of the surface fabric of each shoulder strap, and there is no interference with the design of the backpack of everyday use.

In addition, in the shoulder straps for a backpack according to the present invention, wherein the thicker part of the core material is disposed in a limited range from the upper joint portion or the vicinity of the upper joint portion to a front part of the shoulder, the natural twist of the shoulder straps along the flank from the front part of the shoulder to the armpit is not inhibited, so that the fit of the shoulder strap and the body is not impaired.

Further, in the shoulder straps for a backpack according to the present invention, wherein stretchability of a portion of the surface fabric is larger than stretchability of the other portion of the surface fabric at least in the vicinity of the upper joint portion of each shoulder strap and the backpack main body and on the inside of the shoulder strap, when baggage is carried on the back, the stretchable fabric provided on the inside of the shoulder strap is pulled further downward and extends to keep the balance between the loads applied to the inside and the outside of the shoulder strap. As a result, the slack of the outside of the shoulder strap is eliminated, the load is equally applied to the inside and the outside of the shoulder strap, and the entire shoulder strap is evenly brought into contact with the shoulder.

BRIEF DESCRIPTION OF DRAWINGS

FIG. 1 is a rear view showing a backpack provided with shoulder straps for a backpack of a first embodiment according to the present invention.

FIG. 2 is a cross-sectional view of a portion (F-F') provided with an additional core material of the shoulder straps for a backpack according to the present invention.

FIG. 3(*a*) is a rear view showing a backpack provided with shoulder straps for a backpack of a second embodiment according to the present invention. FIG. 3(*b*) is a rear view showing a backpack provided with shoulder straps for a backpack of a third embodiment according to the present invention.

FIG. 4(*a*) is a front view schematically showing a region where a flow of tension applied to a shoulder strap and a twist occur in a state where a backpack is worn. FIG. 4(*b*) is a side view schematically showing a region where a flow of tension applied to the shoulder strap and a twist occur in a state where the backpack is worn.

FIG. 5(*a*) is a diagram visualizing the distribution and intensity of pressure applied to a shoulder in the comparative example of Example 1. FIG. 5(*b*) is a diagram visualizing the distribution and intensity of pressure applied to a shoulder in the first embodiment of Example 1.

FIG. 6(*a*) is a diagram visualizing the distribution and intensity of pressure applied to a shoulder in the comparative example of Example 2. FIG. 6(*b*) is a diagram visualizing the distribution and intensity of pressure applied to a shoulder in the first embodiment of Example 2. FIG. 6(*c*) is a diagram visualizing the distribution and intensity of pressure applied to a shoulder in the second embodiment of Example 2.

DESCRIPTION OF EMBODIMENTS

Hereinafter, embodiments of shoulder straps for a backpack according to the present invention and a backpack provided therewith will be described in detail with reference to the drawings. It should be noted that the present invention is not limited to these embodiments at all.

As shown in each figure, shoulder straps 2*a*, 2*b*, and 2*c* for a backpack according to the present invention basically include a core material having elasticity, and a surface fabric 5 for covering the core material, and a pair of left and right shoulder straps for a backpack is provided with respect to a backpack main body 1. An upper end portion of the strap is connected to an upper joint portion 11 of the backpack main body 1, and a lower end portion thereof is connected to a lower joint portion 12 of the backpack main body 1 via a lower strap 3.

The upper joint portion 11 is formed near the center of the upper part of the backpack main body 1. On the other hand, the lower joint portion 12 is formed on the left and right lower parts of the backpack main body 1. Due to the positional relationship between the upper joint portion 11 and the lower joint portion 12, when carrying the backpack main body 1 on the back, the distance between the left and right shoulder straps 2 increases as going from the top of the shoulder to the armpit.

FIG. 1 is a rear view of a backpack provided with the first embodiment of the shoulder straps for a backpack according to the present invention, and FIG. 2 is a sectional view of a portion (F-F') of the shoulder strap 2*a* provided with an additional core material 4*b*. In the shoulder strap 2*a* of this embodiment, a difference in elevation between the portion thickened in the core material and the other portion is formed by providing the additional core material 4*b* on part of the back side (surface contacting the body) of a base core material 4*a* formed to be substantially the same as the width in the lateral direction and the length in the longitudinal direction of the shoulder strap 2*a*. In the embodiment described below, the difference in elevation between the portion thickened by the addition of the additional core material 4*b* and the other portion is provided, but means for providing the difference in elevation is not limited to this. The entire core material may be integrally formed with the total thickness of the base core material 4*a* and the additional core material 4*b*, and next, the difference in elevation may be provided by carving out part (inside) which is not thickly formed, and setting the part to the thickness of the base core material 4*a*. Further, in the present specification, "difference in elevation of the core material" means a difference in elevation on the back side of the core material 4, and such difference in elevation does not occur to the front side (the surface not contacting the body).

As shown in the figure, the additional core material 4*b* is formed to have a width of substantially half of that of the base core material 4*a*, is formed to be shorter than the entire length of the base core material 4*a*, and is attached to the rear side (surface contacting the body) of the base core material 4*a* by fixing means such as an adhesive. The additional core material 4*b* is provided to a region having a width of the substantially outer half of the shoulder strap 2*a*, and a predetermined range from the upper joint portion 11 of the shoulder strap 2*a* and the backpack main body 1. In particular, it is preferable that the additional core material 4*b* be provided from the upper joint portion 11 to the range of the front part of the shoulder, more preferably, to the range of 20 cm to 30 cm from the upper joint portion 11. Limiting the range of providing the additional core material 4*b* to this region does not disturb twisting of the shoulder strap 2*a* mainly generated from the front of the shoulder to the armpit, and in addition, does not cause discomfort near the flank when worn.

Also, as shown in the figure, it is preferable that a front end portion 43*b* of the additional core material 4*b* be obliquely formed such that the length of an inner side 42*b* is longer than the length of an outer side 41*b*. In this way, by forming the front end portion 43*b* of the additional core material 4*b* obliquely, the shoulder strap 2 is easy to bend along the front end portion 43*b* and its extension line, and as a result, twisting tends to occur so as to naturally follow the flank from the front part of the shoulder to the armpit, so that it is possible to fit the body.

Both the base core material 4*a* and the additional core material 4*b* can be suitably composed of commonly used synthetic resin foam materials and the like. Among these, polyethylene sponge foam is preferable, and preferably, is elastically deformed appropriately along the unevenness or curved surface of the body in wearing. In particular, a polyethylene sponge foam having a foam density of 20 $kg/m^3$ to 36 $kg/m^3$ is more preferable.

The thickness of the base core material 4*a* is preferably in the range of 5 mm to 10 mm, and the thickness of the additional core material 4*b* is preferably in the range of 2 mm to 5 mm.

As shown in FIG. 2, the base core material 4*a* and the additional core material 4*b* are covered so as to be entirely wound with the surface fabric 5, and both end portions of the surface fabric 5 and the base core material 4*a* are sewn together at a sewn portion 51 along the step boundary (the center line of the shoulder strap 2*a* in this embodiment) between the base core material 4*a* and the additional core material 4*b*. Although the sewing method and the sewing position of the surface fabric 5 are not limited to this embodiment, it is difficult to bend along the shape of the shoulder when sewn at the side end of the shoulder strap 2*a*, and the fit between the shoulder strap and the shoulder may be impaired. In contrast, when sewing is performed on the center side of the shoulder strap 2*a*, preferably, the shoulder strap 2*a* bends more naturally and does not impair the fit with the body.

In particular, since the recessed portion of the sewn portion 51 is formed between the outside of the shoulder strap provided with the additional core material 4*b* and the inside of the shoulder strap not provided with the additional core material 4*b* by sewing along the step boundary between the base core material 4*a* and the additional core material 4*b* as in this embodiment, preferably, a wearer can have a natural feeling without being conscious of the difference in elevation of the core materials 4*a* and 4*b*. It is to be noted that even if the surface fabric 5 and the base core material 4*a* are not sewed together as described above, the function of dispersing the pressure is maintained.

It is preferable that the surface fabric 5 have sufficient flexibility so that the shoulder strap 2*a* can be deformed following the irregularities and curved surface of the shoulder, and polyester fabrics of 200 denier to 900 denier are preferred as a material.

With this configuration, depending on the weight of baggage, the additional core material 4*b* (and the base core material 4*a* at the portion to which the additional core material 4*b* is attached) is crushed in the vicinity of the upper joint portion with the backpack main body so that the balance of the load applied to the inside and the outside of the shoulder strap 2*a* is equalized. As a result, slack does not occur to the outside of the shoulder strap 2*a*, and the load is equally applied to the inside and the outside, so that the entire shoulder strap 2*a* is evenly brought into contact with the shoulder.

FIG. 3(*a*) is a rear view of a backpack provided with the shoulder straps 2 for a backpack of the second embodiment according to the present invention. The shoulder strap 2*b* of this embodiment includes a normal core material (not shown) which does not have a difference in elevation, and has features in that the surface fabric is composed of two types of surface fabrics having different stretchabilities.

In particular, a stretchable fabric 6*a* formed of a material having stretchability larger than that of the surface fabric 5, which is a portion other than the stretchable fabric 6*a*, is provided on the front and rear surfaces with the width of the substantially inner half of the shoulder strap 2*b* from the vicinity of the upper joint portion 11 of the shoulder strap 2*b* to a predetermined range. Preferably, the stretchable fabric 6*a* includes a normal woven rubber, a double raschel knitted fabric or the like. In addition, the polyester fabric or the like used in the first Example can be preferably used for the surface fabric 5 having a smaller stretchability.

The range in which the stretchable fabric 6*a* is provided may be in the range from the vicinity of the upper joint portion 11 to the front part of the shoulder, and it is more preferable to provide the stretchable fabric 6*a* in the range of 5 cm to 20 cm from the upper joint portion 11.

The stretchable fabric 6*a* is provided on the inside of the shoulder strap 2*b* in the vicinity of upper joint portion 11 where the heaviest load is applied to, while the surface fabric 5 having almost no stretchability or no stretchability at all is provided on the outside of the shoulder strap 2*b* which is not heavily loaded. In this way, when carrying the backpack on the back, only the stretchable fabric 6*a* is pulled depending on the weight of baggage, and the shoulder strap 2*b* extends to keep the balance between the loads applied to the inside and the outside of the shoulder strap 2*b*. As a result, the slack on the outside of the shoulder strap 2*b* is eliminated, the load is equally applied to the inside and the outside, and the entire shoulder strap 2*b* is evenly brought into contact with the shoulder.

FIG. 3(*b*) is a rear view of a backpack provided with the shoulder straps for a backpack of the third embodiment according to the present invention. The shoulder strap 2*c* of this embodiment is the same as the second embodiment in that it includes a normal core material (not shown) which does not have a difference in elevation, and the surface fabric is composed of two types of surface fabrics having different stretchabilities, but has following features.

That is, in the shoulder strap 2*c* of this embodiment, in addition to the stretchable fabric 6*a* provided in the vicinity of the upper joint portion 11, a stretchable fabric 6*b* formed of a material having stretchability larger than that of the surface fabric 5, which is a portion other than the stretchable fabric 6*a* and 6*b*, is provided on both the front and rear surfaces of the shoulder strap in the vicinity of connection portion of the shoulder strap 2*c* and the lower strap 3 and with the width of the substantially outer half of the shoulder strap.

In this embodiment, the stretchable fabric 6*a* is provided on the inside of the shoulder strap 2*c* in the vicinity of the upper joint portion 11 where the heaviest load is applied to. Further, the stretchable fabric 6*b* is provided on the outside of the lower portion of the shoulder strap 2*c* in the vicinity of the connection portion with the lower strap 3 where the tension is applied to, and the surface fabric 5 having almost no stretchability or no stretchability at all is provided on the other portion. In this way, when carrying the backpack on the back, the stretchable fabrics 6*a* and 6*b* are pulled depending on the weight of baggage and the tension, and the shoulder strap 2*c* extends to keep the balance between the loads applied to the inside and the outside of the shoulder strap 2*c*. As a result, the slack on the outside of the shoulder strap 2*c* is eliminated, the load is equally applied to the inside and the outside, and the entire shoulder strap 2*c* is evenly brought into contact with the shoulder.

As described above, the shoulder straps 2*a*, 2*b*, and 2*c* for a backpack according to the present invention have the common feature of balancing the loads applied to the inside and the outside of the shoulder strap are balanced by deforming part of the shoulder strap (the outer core material is crushed in the first embodiment, and the stretchable fabric extends in the second embodiment and in the third embodiment) depending on the weight of baggage when carrying the backpack on the back.

As means for dispersing the load of the shoulder straps 2*a*, 2*b*, and 2*c*, each of the above-described first to third embodiments has an effect independently, but it is not an obstacle to combining the first embodiment and the second embodiment. The shoulder strap may be formed to have a difference in elevation provided on the core material such that the thickness of the outside of the shoulder strap is thicker than the thickness of the inside of the shoulder strap, and the surface fabric composed of two types of surface fabrics with different stretchabilities such that the stretchability of the surface fabric at least in the vicinity of the upper joint portion of the shoulder strap and the backpack main body and on the inside of the shoulder strap is larger than the stretchability of the other portion of the surface fabric.

Furthermore, the first embodiment and the third embodiment may be combined. The shoulder strap may be formed to have a difference in elevation provided on the core material such that the thickness of the outside of the shoulder strap is thicker than the thickness of the inside of the shoulder strap, and the surface fabric composed of two types of surface fabrics with different stretchabilities such that the stretchability of the surface fabric on substantially inner half of the front and rear surfaces of the shoulder strap in a range from the upper joint portion of the backpack main body to the front part of the shoulder and on the substantially outer half of the front and rear surfaces of the shoulder strap in the vicinity of the connection portion with the lower strap is larger than the stretchability of the other portion of the surface fabric.

EXAMPLES

Next, the present invention will be described in more detail by giving examples.

Example 1

A backpack provided with a shoulder strap according to the first embodiment of the present invention and a backpack provided with a conventional shoulder strap were prepared. A weight of 7 kg was put into each backpack. A pressure sensor (manufactured by XSENSOR Technology Corporation) was attached to the shoulder of a measurement dummy of standard Japanese body (male in twenties). The average pressure and the contact area of the shoulder straps of each backpack were measured three times, and the results were obtained as shown in Table 1 for the average pressure and Table 2 for the contact area. This test was carried out using a base core material having a thickness of 7 mm and an additional core material having a thickness of 3 mm. In FIG. 5, the distribution and intensity of pressure applied to the shoulder strap is visualized in the test. FIG. 5(*a*) shows the distribution and intensity of pressure applied to the conventional shoulder strap, and FIG. 5(*b*) shows the distribution and intensity of pressure applied to the shoulder strap according to the first embodiment of the present invention. In the figure, the pattern shown on each shoulder strap indicates the part under pressure. The part with the darkest color at the edge of the pattern represents a region with the weakest pressure, the inner part with the bright color represents a region with the stronger pressure, and the innermost part with the dark color represents a region with the strongest pressure.

TABLE 1

| Average pressure | First time | Second time | Third time | ($g/cm^2$) Average |
|---|---|---|---|---|
| Example | 61.79 | 72.28 | 63.96 | 66.01 |
| Comparative example | 155.63 | 164.95 | 106.84 | 142.47 |

TABLE 2

| Contact area *1 | First time | Second time | Third time | Average |
|---|---|---|---|---|
| Example | 9600 | 8380 | 11291 | 9757 |
| Comparative example | 7516 | 7908 | 6778 | 7400 |

*1 Number of pixels of contact region on processing software screen

As can be seen from the above test results, it was found in the shoulder straps for a backpack according to the first embodiment that the average pressure due to the load was decreased, and the contact area to the shoulder was widened, compared with the case of the conventional shoulder strap without a difference in elevation provided by the additional core material 4*b*. Furthermore, as shown in FIG. 5, it was found that the shoulder straps for a backpack according to the first embodiment was pressurized over the entire shoulder strap, compared with the conventional shoulder strap without a difference in elevation provided by the additional core material 4*b*.

Example 2

A backpack provided with a shoulder strap according to the first and second embodiments of the present invention and a backpack provided with a conventional shoulder strap were prepared. A weight of 7 kg was put into each backpack. A pressure sensor (manufactured by XSENSOR Technology Corporation) was attached to the shoulder of a medium-sized male in his 40's. The average pressure and the contact area of left and right shoulder straps of each backpack were measured, and the results were obtained as shown in Table 3 for the average pressure and Table 4 for the contact area. Since the configuration of the backpack provided with the shoulder strap according to the first embodiment used for the test is the same as that of Example 1, its description is omitted. On the other hand, the backpack provided with the shoulder strap according to the second embodiment was configured such that a normal woven rubber was provided on both the front and rear surfaces having a width of the substantially inner half over the range of 15 cm from the upper joint portion of the shoulder strap, and the other portion was composed of 600 denier polyester fabric. In FIG. 6, the distribution and intensity of pressure applied to the shoulder strap is visualized in the test. FIG. 6(*a*) shows the distribution and intensity of pressure applied to the conventional shoulder strap, FIG. 6(*b*) shows the distribution and intensity of pressure applied to the shoulder strap according to the first embodiment of the present invention, and FIG. 6(*c*) shows the distribution and intensity of pressure applied to the shoulder strap according to the second embodiment of the present invention. In the figure, the pattern shown on each shoulder strap indicates the part under pressure. Since the description of the pattern is the same as that of Example 1, its description is omitted.

TABLE 3

| Average pressure | Left shoulder | Right shoulder | (g/cm$^2$) Average |
|---|---|---|---|
| First embodiment | 20.82 | 26.6 | 23.71 |
| Second embodiment | 22.03 | 28.85 | 25.44 |
| Comparative example | 34.29 | 39.25 | 36.77 |

TABLE 4

| Contact area *1 | Left shoulder | Right shoulder | Total |
|---|---|---|---|
| First embodiment | 5091 | 5183 | 10274 |
| Second embodiment | 4810 | 4938 | 9748 |
| Comparative example | 3532 | 3962 | 7494 |

*1 Number of pixels of contact region on processing software screen

As can be seen from the above test results, it was found in the shoulder straps for a backpack according to the first and second embodiments that the average pressure due to the load was decreased, and the contact area to the shoulder was widened, compared with the case of the conventional shoulder strap.

REFERENCE SIGNS LIST

1 Backpack main body
2*a* Shoulder strap (first embodiment)
2*b* Shoulder strap (second embodiment)
2*c* Shoulder strap (third embodiment)
3 Lower strap
4*a* Base core material
4*b* Additional core material
5 Surface fabric
6*a* Stretchable fabric
6*b* Stretchable fabric
11 Upper joint portion
12 Lower joint portion
51 Sewn portion
41*b* Outer side
42*b* Inner side
43*b* End portion
A Region where tension flow moves
B Region where twist is applied to shoulder strap

The invention claimed is:

1. A pair of left and right shoulder straps for a backpack to be worn by a wearer having a shoulder, each of the shoulder straps for the backpack comprising an upper end portion and a lower end portion, the upper end portion being joined to an upper part of a main body of the backpack at an upper joint portion, the lower end portion being joined to a lower part of the main body of the backpack via a lower strap, each of the shoulder straps for the backpack comprising a core material having elasticity, the core material extending over an entire length of each respective shoulder strap, and a surface fabric covering the core material, wherein a part of the core material provided from the upper joint portion or a vicinity of the upper joint portion at least to an armpit part has a difference in elevation so that a thickness of an outside of each shoulder strap is thicker than a thickness of an inside of each shoulder strap at least at a portion configured to come into contact with a body, and wherein the part of the core material having the difference in elevation is provided in a limited range from the upper joint portion or the vicinity of the upper joint portion to a front part of a shoulder.

2. The shoulder straps for a backpack according to claim 1, wherein the thicker part of the core material is disposed in a limited range of 20 to 30 cm from the upper joint portion or the vicinity of the upper joint portion to a front part of a shoulder.

3. The shoulder straps for a backpack according to claim 1, wherein the thicker part of the core material is formed on a substantially outer half of each shoulder strap.

4. The shoulder straps for a backpack according to claim 1, wherein a front end portion of the thicker part of the core material is obliquely formed so that a length of an inner side of the thicker part is longer than a length of an outer side of the thicker part.

5. The shoulder straps for a backpack according to claim 1, wherein the thicker part of the core material is formed by attaching an additional core material to an outer rear surface of a base core material formed with a width of each shoulder strap.

6. The shoulder straps for a backpack according to claim 1, wherein the core material is composed of a polyethylene sponge foam having a foam density of 20 kg/m3 to 36 kg/m3.

7. The shoulder straps for a backpack according to claim 1, wherein the thickness of the core material other than the thicker part is 5 mm to 10 mm.

8. The shoulder straps for a backpack according to claim 1, wherein the difference in elevation of the core material is 2 mm to 5 mm.

9. The shoulder straps for a backpack according to claim 1, wherein the core material formed to be thick and the core material other than the thicker part are covered so as to be entirely wound with the surface fabric, and both end portions of the surface fabric and the core material other than the thicker part are sewn together at a sewn portion along a step boundary between the core material formed to be thick and the core material other than the thicker part.

10. A backpack comprising the shoulder straps for a backpack according to claim 1.

11. The shoulder straps for a backpack according to claim 2, wherein the thicker part of the core material is formed on a substantially outer half of each shoulder strap.

12. The shoulder straps for a backpack according to claim 2, wherein a front end portion of the thicker part of the core material is obliquely formed so that a length of an inner side of the thicker part is longer than a length of an outer side of the thicker part.

13. The shoulder straps for a backpack according to claim 3, wherein a front end portion of the thicker part of the core material is obliquely formed so that a length of an inner side of the thicker part is longer than a length of an outer side of the thicker part.

14. The shoulder straps for a backpack according to claim 2, wherein the thicker part of the core material is formed by attaching an additional core material to an outer rear surface of a base core material formed with a width of each shoulder strap.

15. A pair of left and right shoulder straps for a backpack to be worn by a wearer having a shoulder, each of the shoulder straps for the backpack comprising an upper end portion and a lower end portion, the upper end portion being joined to an upper part of a main body of the backpack at an upper joint portion, the lower end portion being joined to a lower part of the main body of the backpack via a lower strap, each of the shoulder straps for the backpack comprising a core material having elasticity, and a surface fabric covering the core material, wherein a part of the core material provided from the upper joint portion or a vicinity of the upper joint portion at least to an armpit part has a difference in elevation so that a thickness of an outside of each shoulder strap is thicker than a thickness of an inside of each shoulder strap at least at a portion configured to come into contact with a body, and wherein the part of the core material having the difference in elevation is provided in a limited range from the upper joint portion or the vicinity of the upper joint portion to a front part of a shoulder, and wherein the thicker part of the core material has a front end portion at its end farthest from the upper end portion, the core material extends toward the lower end portion beyond the front end portion of the thicker part of the core material, and the thicker part of the core material is obliquely formed so that a length of an inner side of the thicker part is longer than a length of an outer side of the thicker part.

* * * * *